US005499744A

United States Patent [19]

Hawkins

[11] Patent Number: 5,499,744

[45] Date of Patent: Mar. 19, 1996

[54] LOW PROFILE DRINK DISPENSER

[75] Inventor: John T. Hawkins, San Antonio, Tex.

[73] Assignee: Lancer Corporation, San Antonio, Tex.

[21] Appl. No.: 237,375

[22] Filed: May 3, 1994

[51] Int. Cl.[6] ..... B67D 5/56

[52] U.S. Cl. ..... 222/129.1; 222/146.6; 62/392

[58] Field of Search ..... 222/129.1, 129.2, 222/129.3, 146.1, 146.6, 54; 62/389, 392, 399

[56] References Cited

U.S. PATENT DOCUMENTS

| | | | |
|---|---|---|---|
| 3,892,335 | 7/1975 | Schroeder | 222/129.1 |
| 4,555,371 | 11/1985 | Jeans | 222/129.1 |
| 4,595,131 | 6/1986 | Ruskin et al. | 222/640 |
| 4,651,862 | 3/1987 | Greenfield, Jr. | 222/129.1 |
| 4,916,910 | 4/1990 | Schroeder | 62/59 |
| 4,934,150 | 6/1990 | Fessler | 62/392 |
| 4,979,647 | 12/1990 | Hassell | 222/146.6 |
| 5,141,130 | 8/1992 | Wilzy et al. | 222/1 |
| 5,190,188 | 3/1993 | Credle, Jr. | 222/1 |
| 5,319,947 | 6/1994 | Fischer | 62/389 |
| 5,392,960 | 2/1995 | Kendt et al. | 222/129.1 |

*Primary Examiner*—Andres Kashnikow

*Assistant Examiner*—Lisa Douglas

*Attorney, Agent, or Firm*—Donald R. Comuzzi; Christopher L. Makay

[57] ABSTRACT

A beverage dispenser includes a housing that defines a cooling chamber and has dispensing nozzles mounted thereon, a water line positioned in the bottom of the cooling chamber for communicating water to the dispensing nozzles, product lines mounted in the front of the cooling chamber for communicating product to the dispensing valves, a refrigeration unit mounted over the cooling chamber that includes an evaporator coil extending into the cooling chamber, and an agitator motor mounted over the cooling chamber for driving an impeller located within the cooling chamber. The cooling chamber contains a cooling fluid, a portion of which freezes about the evaporator coil during the operation of the refrigeration unit to form a frozen cooling fluid slab. A frozen cooling fluid bank controller controls the size of the frozen cooling fluid slab, while the mounting of the controller's probe to the side of the evaporator coil facing the front of the housing prevents the frozen cooling fluid slab from freezing to envelop the product lines. The agitator motor drives the impeller to force the unfrozen cooling fluid circuitously about the frozen cooling fluid slab. Additionally, a serpentine configuration of the water line produces channels which direct the flow of unfrozen cooling fluid towards the front and rear walls of the housing, thereby enhancing the circulation of the unfrozen cooling fluid.

4 Claims, 3 Drawing Sheets

LOW PROFILE DRINK DISPENSER

BACKGROUND OF THE INVENTION

1. Field of the Invention

The present invention relates to beverage dispensers and, more particularly, but not by way of limitation, to a beverage dispenser with an improved component configuration which increases both beverage dispensing capacity and the quantity of beverages dispensed at a temperature below the industry standard of 42° F.

2. Description of the Related Art

The rental or purchase of commercial real estate suitable for the operation of food and drink service establishments is extremely expensive, especially in large metropolitan areas. Consequently, available space must be utilized with maximum efficiency, particularly countertop space which provides the service area for customers as well as additional customer seating. Thus, beverage dispensers which typically reside on countertops must be compact to occupy the least amount of countertop space.

Although beverage dispenser size is important, the principal beverage dispenser criteria remains beverage dispensing capacity. That is, beverage dispensers must dispense beverages at a temperature below the 42° F. industry standard while still satisfying customer demand. Unfortunately, beverage dispensers capable of serving high volumes typically are bulky and occupy large amounts of countertop space.

Conversely, compact beverage dispensers rarely have drink dispensing capacities sufficient to serve large numbers of customers. Therefore, any beverage dispenser design must balance size and compactness against drink dispensing capacity. Accordingly, the primary objective in the design of beverage dispensers is to decrease their size while increasing or at least maintaining their current beverage dispensing capacity.

U.S. Pat. No. 3,892,335 issued Jul. 1, 1975 to Schroeder discloses an early beverage dispenser design which attempts to combine compactness with increased beverage dispensing capacity. The beverage dispenser of U.S. Pat. No. 3,892,335 includes a housing which defines a cooling chamber containing a cooling fluid. A refrigeration unit which resides over the cooling chamber includes an evaporator coil extending into the cooling chamber. Product and water lines which are surrounded by the evaporator coil reside within the center of the cooling chamber. The product and water lines communicate with a product and water source, respectively, to deliver the product and water, which is typically carbonated water, to beverage dispensing valves.

In operation, the refrigeration unit cools the cooling fluid so that the cooling fluid freezes in a slab about the evaporator coil. An agitator motor drives an impeller via a shaft to circulate unfrozen cooling fluid about the cooling chamber. That circulation provides the heat exchange between the product and water lines and the cooling fluid because, as the unfrozen cooling fluid circulates, it receives heat from the product and water lines and delivers that heat to the frozen cooling fluid slab. As a result, the frozen cooling fluid melts to dissipate the heat from the product and water so that a cold beverage is dispensed from the dispensing valves.

Proper circulation requires a steady flow of the unfrozen cooling fluid from underneath the frozen cooling fluid slab, around its sides, over its top, and back through its center. Circulation of the unfrozen cooling fluid along the above-described path is essential to the heat exchange process which produces cool drinks and increases beverage dispensing capacity. Unfortunately, the placement of the water and product lines in the center of the cooling chamber reduces the circulation of unfrozen cooling fluid about the product and water lines and the frozen cooling fluid slab. That is, the product and water lines prevent the unfrozen cooling fluid from flowing through the center of the frozen cooling fluid slab which severely limits the contact between the frozen and unfrozen cooling fluid. Consequently, the beverage dispenser disclosed in U.S. Pat. No. 3,892,335 fails to provide maximum heat exchange between the product and water and the cooling fluid which results in a diminished beverage dispensing capacity.

U.S. Pat. No. 4,916,910 issued Apr. 17, 1990 to Schroeder discloses a beverage dispenser which moves the product and water lines from within the evaporator coil to a position on the bottom of the cooling chamber underneath the evaporator coil. That position change allows the height of the evaporator coil to be reduced which provides the beverage dispenser with a low profile. Unfortunately, although the size of the beverage dispenser has been decreased, the problem of increasing the heat exchange between the cooling fluid and product and water has not been solved.

Maximum heat exchange from the product and water to the cooling fluid occurs when the unfrozen cooling fluid contacts the frozen cooling fluid slab over a maximum surface area. In the beverage dispenser of U.S. Pat. No. 4,916,910, the compressed evaporator coil completely freezes the cooling fluid above the product and water lines all the way to the edges of the cooling chamber so that no circulation of unfrozen cooling fluid about the frozen cooling fluid slab occurs. Consequently, insufficient heat exchange develops because the unfrozen cooling fluid only contacts the bottom of the frozen cooling fluid slab. Accordingly, heat exchange is diminished because the area of contact between the unfrozen cooling fluid and the frozen cooling fluid slab has been minimized.

Accordingly, a beverage dispenser design which occupies a minimum of countertop space while permitting the contact between the unfrozen cooling fluid and the frozen cooling fluid slab to occur along a maximum surface area to provide maximum heat exchange, thereby increasing drink dispensing capacity, is highly desirable.

SUMMARY OF THE INVENTION

In accordance with the present invention, a beverage dispenser comprises a housing which defines a cooling chamber, a water line positioned in the bottom of the cooling chamber, product coils positioned in the front of the cooling chamber, an agitator, and a refrigeration unit mounted over the cooling chamber which includes an evaporator coil that extends into the cooling chamber. The product lines and water line communicate with dispensing valves mounted on the housing to deliver a product, typically a beverage syrup, and water, typically carbonated water, to each of the dispensing valves, respectively. The cooling chamber contains a cooling fluid, typically water, for removing heat from the product and water flowing through the product lines and water line, respectively. The agitator circulates the cooling fluid about the cooling chamber to enhance the heat exchange between the cooling fluid and product and water.

The refrigeration unit operates to cool the cooling fluid such that a slab of frozen cooling fluid forms about the evaporator coil. A frozen cooling fluid bank controller controls the operation of the refrigeration unit to prevent the frozen cooling fluid bank from growing to large. The controller includes a probe mounted to the side of the evaporator coil facing the front of the housing. When the thickness of the frozen cooling fluid slab decreases to a predetermined point, the probe signals the controller which then activates the refrigeration unit to freeze more of the unfrozen cooling fluid to produce a larger slab. Once the thickness of the frozen cooling fluid slab has grown to a desired thickness, the probe signals the controller which deactivates the refrigeration unit. Accordingly, the positioning of the probe on the side of the evaporator coil facing the front of the housing prevents the frozen cooling slab from growing into and most likely freezing the product lines.

The placement of the product lines in the front of the cooling chamber and the water line in the bottom of the cooling chamber significantly increases the drink dispensing capacity of the beverage dispenser by permitting increased circulation of the unfrozen cooling fluid. More particularly, the removal of the product lines and the water line from the center of the evaporator coil eliminates the obstruction to the flow of unfrozen cooling fluid experienced by beverage dispensers having one or both of the product and water lines centered within the evaporator coil. Additionally, the water line includes a serpentine configuration to produce channels between the individual turns of the tubing comprising the water line. Those channels are provided to direct the flow of the unfrozen cooling fluid towards the front and rear wall of the housing which increases the circulation of the unfrozen cooling fluid.

Accordingly, the completely unobstructed path for the unfrozen cooling fluid about all sides of the frozen cooling fluid slab as well as through the center of the frozen cooling fluid slab coupled with the channels of the water line increases the circulation of the unfrozen cooling fluid to provide maximum surface area contact between the frozen and unfrozen cooling fluid. That maximum surface area contact results in maximum heat exchange from the product and water to the unfrozen cooling fluid and then to the frozen cooling fluid slab. Consequently, the beverage dispenser exhibits an increased beverage dispensing capacity because the unfrozen cooling fluid maintains a temperature of approximately 32° F. even during peak use periods due to its increased circulation and corresponding increased heat exchange.

It is, therefore, an object of the present invention to provide a beverage dispenser design which enhances the circulation of an unfrozen cooling fluid flowing within a cooling chamber.

It is another object of the present invention to provide a beverage dispenser with a water line positioned at the bottom of a cooling chamber wherein the serpentine configuration of the water line defines channels which direct the flow of unfrozen cooling fluid toward the front and rear of the cooling chamber.

It is a further object of the present invention to provide a beverage dispenser with a probe at the front of the cooling chamber for sensing frozen cooling fluid slab size to prevent the frozen cooling fluid slab from freezing into the product lines.

Still other objects, features, and advantages of the present invention will become evident to those skilled in the art in light of the following.

DETAILED DESCRIPTION OF THE PREFERRED EMBODIMENT

Figure 1:
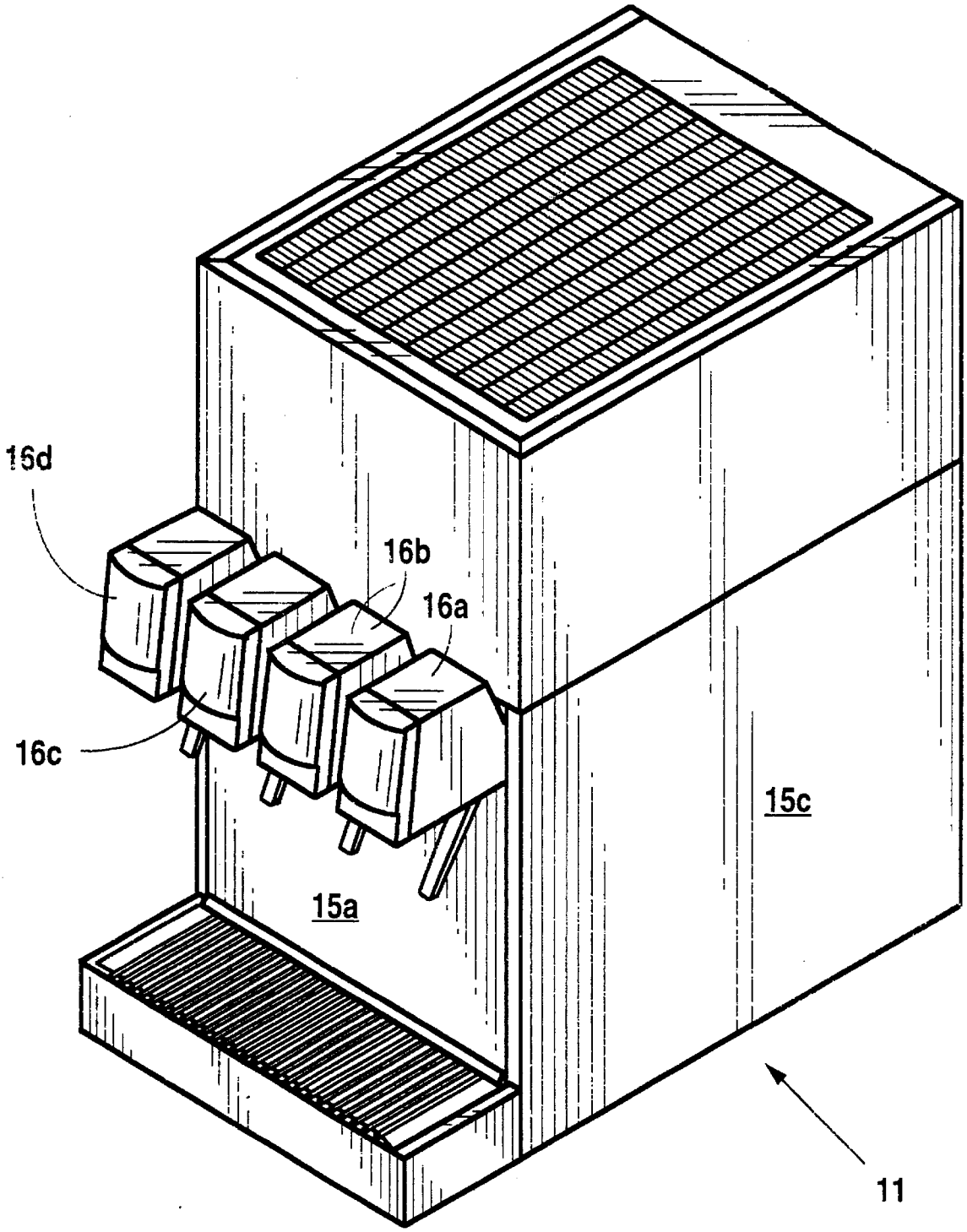
FIG. 1 is a perspective view depicting the beverage dispenser of the present invention.
Figure 2:
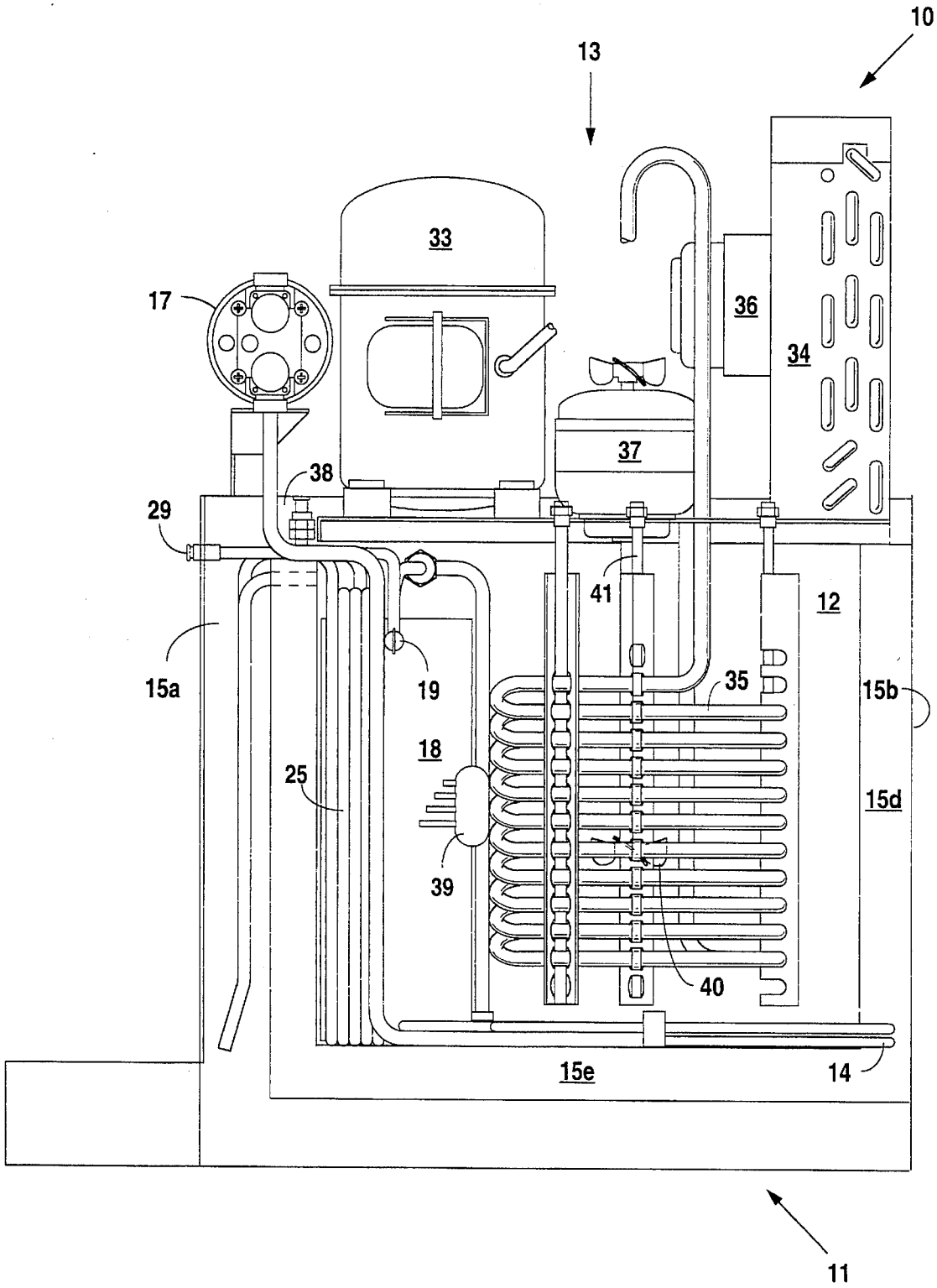
FIG. 2 is a side elevation view in cross-section depicting the beverage dispenser of the present invention.
Figure 3:
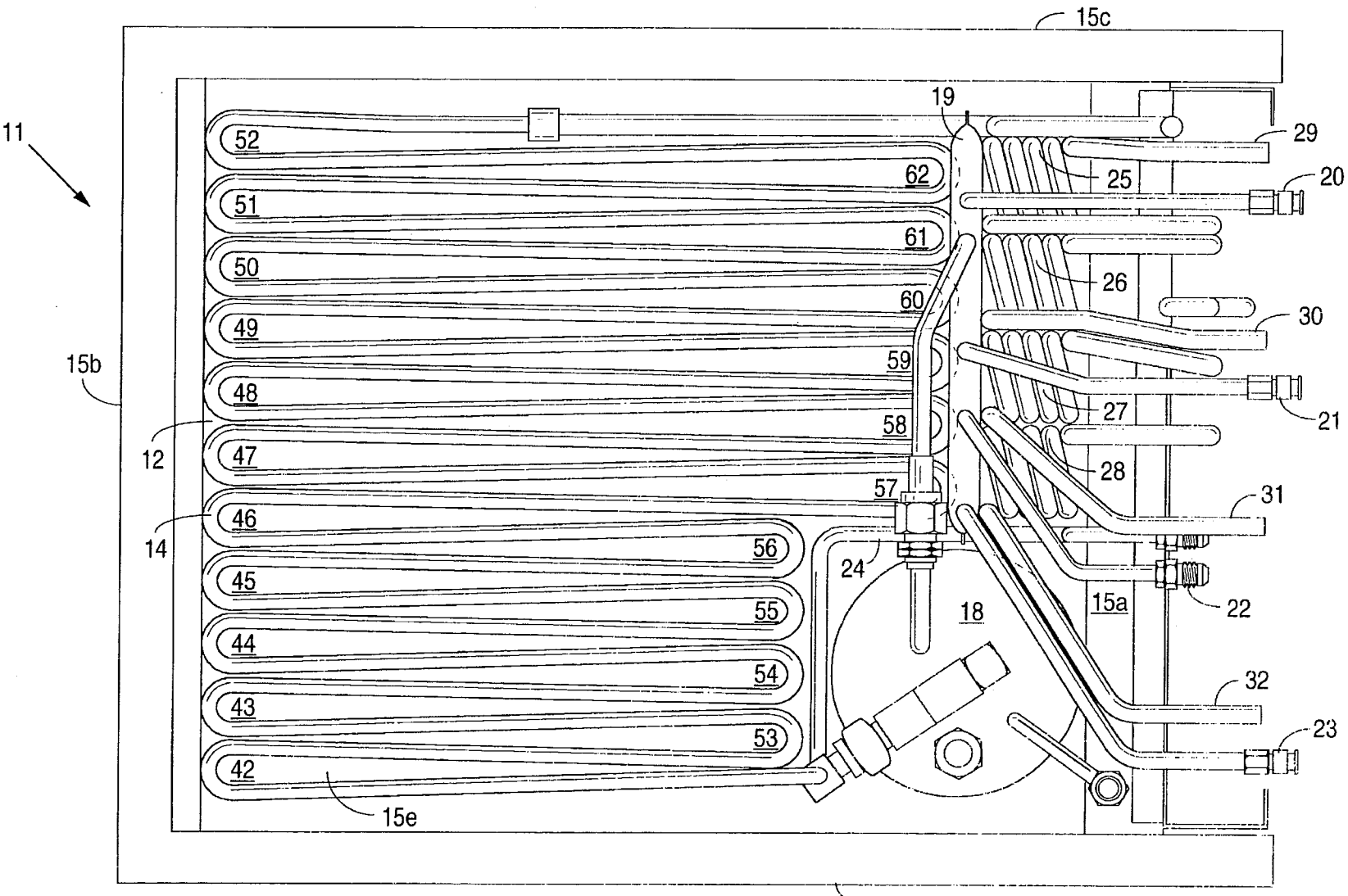
FIG. 3 is a top elevation view depicting the positioning of the product and water lines within the cooling chamber of the present invention.

As illustrated in FIGS. 1–3, beverage dispenser 10 includes housing 11, refrigeration unit 13, water line 14, product lines 25–28, and dispensing valves 16A–D. Housing 11 comprises front wall 15A, rear wall 15B, side walls 15C and D, and bottom 15E which define cooling chamber 12. Cooling chamber 12 contains a cooling fluid which is typically water. Dispensing valves 16A–D each connect to front wall 15A using any suitable means such as nuts and bolts.

Water line 14 includes a serpentine configuration to permit its placement on the bottom of cooling chamber 12. Water line 14 mounts to bottom 15E of housing 11 using any suitable means such as brackets. The inlet into water line 14 connects to water pump 17 which, in turn, connects to any suitable water source such as a public water line. The outlet from water line 14 connects to a T-connecter (not shown).

The T-connector delivers the water received from water line 14 to carbonator 18 from one of its outlets. Carbonator 18 connects to and receives $CO_2$ from a $CO_2$ source to carbonate the water delivered from water line 14 via one of the outlets from the T-connecter. Carbonator 18 mounts within the front of cooling chamber 12 using any suitable means such as brackets.

The outlet from carbonator 18 connects to the inlet into manifold 19. Manifold 19 connects at one end to carbonator 18 and at an opposite end to side wall 15C of housing 11 using any suitable means such as brackets. Manifold 19 receives the carbonated water from carbonator 18 and delivers it to dispensing valves 16A–D via its outlets 20–23, respectively. Alternatively, the second outlet from the T-connecter may be attached to dispensing valves 16C via line 24 to deliver plain water directly to dispensing valve 16C.

Product lines 25–28 reside in the front of cooling chamber 12 and mount within cooling chamber 12 using any suitable means such as brackets. Additionally, manifold 19 mounts to carbonator 18 and side wall 15C of housing 11 such that it resides directly behind and abuts the backs of each of product lines 25–28. Manifold 19 abuts product lines 25–28 to prevent their movement away from front wall 15A of housing 11.

Each of product lines 25–28 includes an inlet (not shown) which communicates with a product source (not shown). Furthermore, product lines 25–28 include outlets 29–32 which connect to dispensing valves 16A–D, respectively, to supply product to dispensing valve 16A–D. Although four product lines and dispensing valves are disclosed, one of ordinary skill in the art will recognize that additional product lines and dispensing valves or fewer product lines and dispensing valves may be implemented through a corresponding change in size of housing 11.

Refrigeration unit 13 comprises a standard beverage dispenser refrigeration system which includes compressor 33, condenser coil 34, evaporator coil 35, and fan 36. Compressor 33 and condenser coil 34 mount on top of platform 38 while evaporator coil 35 mounts underneath. Fan 36 mounts to condenser coil 34 to blow air across condenser coil 34 to facilitate the exchange of heat. Platform 38 mounts on top of housing 11 so that evaporator coil 35 will reside above water line 14 within the center portion of cooling chamber 12.

Refrigeration unit 13 operates similarly to any standard beverage dispenser refrigeration system to cool the cooling fluid residing within cooling chamber 12 such that the cooling fluid freezes in a slab about evaporator coil 35. Refrigeration unit 13 cools and ultimately freezes the cooling fluid to facilitate heat exchange between the cooling fluid and product and water so that a cool beverage may be dispensed from beverage dispenser 10. However, because complete freezing of the cooling fluid results in an inefficient heat exchange, a cooling fluid bank control system (not shown) regulates the operation of compressor 33 to prevent the complete freezing of the cooling fluid. The cooling fluid bank control system utilized in beverage dispenser 10 is disclosed in U.S. Pat. No. 4,823,556 which issued Apr. 25, 1989 to Chestnut and is assigned to the assignee of the present invention. The disclosure of U.S. Pat. No. 4,823,556 is hereby incorporated by reference.

Although the electronic components comprising the cooling fluid bank control system of beverage dispenser 10 are similar to those disclosed in U.S. Pat. No. 4,823,556, the operation of beverage dispenser 10 has been significantly improved by the relocation of probe 39. Specifically, probe 39 mounts to the side of evaporator coil 35 facing front wall 15A to prevent the cooling fluid from freezing into product lines 25–28. Probe 39 prevents the slab of frozen cooling fluid from freezing into product lines 25–28 because, once the frozen cooling fluid slab reaches the outer sensor coil of probe 39, probe 39 signals the cooling fluid bank control system to deactivate compressor 33. Compressor 33 remains deactivated until the frozen cooling fluid slab melts beyond the inner sensor coil of probe 39 and exposes the inner sensor to the unfrozen cooling fluid. After the inner sensor coil contacts the unfrozen cooling fluid, probe 39 signals the cooling fluid bank control system to activate compressor 33, which runs until the frozen cooling slab again reaches the outer sensor coil of probe 39. Accordingly, probe 39 and the cooling fluid bank control system regulate the operation of compressor 33 such that it never remains activated for a time period sufficient to allow the frozen cooling fluid slab to grow into product lines 25–28.

Agitator motor 37 mounts onto platform 38 to drive impeller 40 via shaft 41. Agitator motor 37 drives impeller to circulate the unfrozen cooling fluid around the frozen cooling fluid slab as well as water line 14 and product lines 25–28. Impeller 40 circulates the unfrozen cooling fluid to enhance the heat exchange which naturally occurs between the low temperature cooling fluid and the higher temperature product and water. Heat exchange results from the product and water flowing through product lines 25–28 and water line 14, respectively, giving up heat into the unfrozen cooling fluid. The unfrozen cooling fluid then transfers the heat to the frozen cooling fluid slab which receives the heat and melts in response to deliver cooling fluid as a liquid into cooling chamber 12. The heat originally exchanged from the product and water into the cooling fluid is thus dissipated through the melting of the frozen cooling fluid slab. Accordingly, that dissipation of heat and corresponding melting of the frozen cooling fluid slab maintain the unfrozen cooling fluid at the desired temperature of 32° F.

The effectiveness of the above-described exchange of heat relates directly to the amount of surface area contact between the unfrozen cooling fluid and the frozen cooling fluid slab. That is, if the unfrozen cooling fluid contacts the frozen cooling fluid slab along a maximum amount of its surface area, the exchange of heat significantly increases. Beverage dispenser 10 maintains maximum contact of unfrozen cooling fluid along the surface of the frozen cooling fluid slab due to the placement of product lines 25–28 in the front portion of cooling chamber 12 and the serpentine configuration of water line 14 coupled with the positioning in the bottom of cooling chamber 12.

Specifically, the removal of the product lines and the water line from the center of the evaporator coil eliminates the obstruction to the flow of unfrozen cooling fluid experienced by beverage dispensers having one or both of the product and water lines centered within the evaporator coil. Furthermore, the placement of the product coils in the front portion of cooling chamber 12 permits the size of evaporator coil 35 to be increased without a corresponding increase in the height of housing 11. As a result of increasing the size of evaporator coil 35, a larger frozen cooling fluid slab forms. The larger frozen cooling fluid slab provides a greater surface area for the transfer of heat from the unfrozen cooling. That increase in heat exchange from the unfrozen cooling fluid to the frozen cooling fluid slab maintains the unfrozen cooling fluid at 32° F. even during peak use periods of beverage dispenser 10. Consequently, the heat extracted from the product and water increases to significantly increase the beverage dispensing capacity of beverage dispenser 10.

Alternatively, both the height of housing 11 and evaporator coil 35 could be reduced because, even with a smaller evaporator coil, the resulting smaller beverage dispenser would still have the same beverage dispensing capacity as current drink dispensers.

Additionally, the serpentine configuration of water line 14 increases the effectiveness of the circulation of the unfrozen cooling fluid by impeller 40. The serpentine configuration of water line 14 produces channels 42–62 which are defined by each turn of the tubing which comprises water line 14. Channels 42–62 of water line 14 are provided to direct the flow of unfrozen cooling fluid towards front wall 15A and back wall 15B of housing 11.

Thus, in operation, agitator motor 37 drives impeller 40 to force unfrozen cooling fluid from the channel defined by evaporator coil 35 towards water line 14. As the unfrozen cooling fluid enters channels 42–62, channels 42–62 direct the unfrozen cooling fluid towards front wall 15A and back wall 15B of housing 11. More particularly, channels 52–62 divide the unfrozen cooling fluid such that the unfrozen cooling fluid entering channels 53–62 flows towards front wall 15B to form a first unfrozen fluid stream, while the unfrozen cooling fluid entering channels 42–52 flows towards back wall 15B to form a second unfrozen fluid stream. The flowing of the unfrozen cooling fluid through channels 42–62 produces an exchange of heat from the water to the unfrozen cooling fluid. Similarly, the unfrozen cooling fluid contacts the underside of the frozen cooling fluid slab to produce heat exchange therebetween.

As the first unfrozen cooling fluid stream flows into the front portion of cooling chamber 12, it contacts product lines 25–28 to remove heat from the product flowing therein. Furthermore, the unfrozen cooling fluid contacts the frozen cooling fluid slab to exchange heat therebetween. Additionally, as the second unfrozen cooling fluid stream flows into the rear portion of cooling chamber 12, it contacts the frozen cooling fluid slab to produce heat exchange therebetween.

The first and second unfrozen cooling fluid streams circulate from the front and rear portions of cooling chamber 12, respectively, into the top portion of cooling chamber 12. As the first and second unfrozen cooling fluid streams enter the top portion of cooling chamber 12, they contact the top of the frozen cooling fluid slab to produce heat exchange therebetween. Furthermore, the first and second cooling fluid streams flow into the channel defined by evaporator coil 35 where they recombine to contact the frozen cooling fluid slab for a further heat exchange. The recombined cooling fluid streams entering the channel defined by evaporator coil 35 are again forced from the channel towards water line 14 so that the above-described circulation repeats.

Additionally, impeller 40 propels unfrozen cooling fluid from the channel defined by evaporator coil 35 towards side walls 15C and D of housing 11. The unfrozen cooling fluid divides into third and fourth unfrozen cooling fluid streams which travel a circuitous path around the sides of the frozen cooling fluid slab, over the top of the frozen cooling fluid slab, and back to the channel defined by evaporator coil 35. That flow of the third and fourth unfrozen cooling fluid streams produces additional heat exchange from the product and water to the unfrozen and frozen cooling fluid.

Accordingly, the completely unobstructed path for the unfrozen cooling fluid about all sides of the frozen cooling fluid slab as well as through the center of the frozen cooling fluid slab provides maximum surface area contact between the frozen and unfrozen cooling fluid. That maximum surface area contact results in maximum heat exchange from the product and water to the unfrozen cooling fluid and then to the frozen cooling fluid slab. Consequently, beverage dispenser 10 exhibits an increased beverage dispensing capacity because the unfrozen cooling fluid maintains a temperature of approximately 32° F. even during peak use periods due to its increased circulation and corresponding increased heat exchange.

Furthermore, the unobstructed flow of unfrozen cooling fluid about the frozen cooling fluid slab, especially the increased flow about the front and rear portions of cooling chamber 12 resulting from channels 42–62, prevents the frozen cooling fluid slab from freezing to walls 15 A–D of housing 11. Probe 39 prevents the freezing of the frozen cooling fluid slab to front wall 15A of housing 11, however, the frozen cooling fluid slab might freeze to rear wall 15B and side walls 15C and D of housing 11 without the increased and unobstructed flow of the unfrozen cooling fluid. That is, the continuous and circuitous circulation of the unfrozen cooling fluid about all four sides of the frozen cooling fluid slab produces constant melting of the frozen cooling fluid slab. That constant melting of the frozen cooling fluid slab prevents it from growing to rear wall 15B and side walls 15C and D.

Without the constant circulation of unfrozen cooling fluid, the same unfrozen cooling fluid would remain between rear wall 15B and side walls 15C and D the frozen cooling fluid slab. Eventually, that unagitated unfrozen cooling fluid would freeze because it would not receive sufficient heat from the product and water to prevent its freezing. Accordingly, the increased circulation of unfrozen cooling fluid produced by the configuration of beverage dispenser 10 not only produces a larger beverage dispensing capacity in beverage dispenser 10, but it also prevents a freeze up of cooling fluid which would severely limit that beverage dispensing capacity.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims which follow.

I claim:

1. A beverage dispenser, comprising:

a housing defining a cooling chamber having a cooling fluid contained therein;

dispensing valves mounted on said housing;

a water line for communicating water to said dispensing valves wherein said water line is substantially completely disposed in the bottom of said cooling chamber and has a serpentine configuration defining channels that direct the flow of unfrozen cooling fluid towards a front portion and rear portion of said cooling chamber;

product lines positioned in the front of said cooling chamber for communicating product to said dispensing valves;

a refrigeration unit mounted over said cooling chamber, said refrigeration unit having an evaporator coil extending into said cooling chamber for freezing cooling fluid thereabout; and an agitator for circulating unfrozen cooling fluid along a circuitous path about the interior and exterior of the cooling fluid slab.

2. The apparatus according to claim 1 further comprising a frozen cooling fluid bank controller having a probe mounted to a side of said evaporator coil facing a front portion of said housing.

3. The beverage dispenser according to claim 1 further comprising a carbonator mounted within said cooling chamber and connected to said water line and a $CO_2$ source to supply carbonated water to said dispensing valves.

4. The beverage dispenser according to claim 3 further comprising a manifold mounted within said cooling chamber directly behind an abutting said product lines to receive carbonated water from said carbonator and distribute the carbonated water to the dispensing valves.

* * * * *

US005499744C1

(12) EX PARTE REEXAMINATION CERTIFICATE (6307th)

United States Patent
Hawkins

(10) Number: US 5,499,744 C1
(45) Certificate Issued: Jul. 22, 2008

(54) LOW PROFILE DRINK DISPENSER

(75) Inventor: John T. Hawkins, San Antonio, TX (US)

(73) Assignee: Lancer Partnership Ltd., San Antonio, TX (US)

Reexamination Request:
No. 90/006,794, Oct. 15, 2003

Reexamination Certificate for:

| | |
|---|---|
| Patent No.: | **5,499,744** |
| Issued: | **Mar. 19, 1996** |
| Appl. No.: | **08/237,375** |
| Filed: | **May 3, 1994** |

(51) Int. Cl.
*B67D 5/56* (2006.01)

(52) U.S. Cl. ..... 222/129.1; 222/146.6; 62/392
(58) Field of Classification Search ..... None
See application file for complete search history.

(56) References Cited

U.S. PATENT DOCUMENTS

| | | | | |
|---|---|---|---|---|
| 2,807,941 | A | 10/1957 | Kraft | 62/4 |
| 3,892,335 | A | 7/1975 | Schroeder | 222/129.1 |
| 4,272,968 | A | 6/1981 | Harvill | 62/394 |
| 4,592,490 | A | 6/1986 | McMichael | 222/129.1 |
| 4,615,466 | A | 10/1986 | Credle, Jr. | 222/129.1 |
| 4,617,807 | A | 10/1986 | Pritchett et al. | 62/399 |
| 4,886,190 | A | 12/1989 | Kirschner et al. | 222/57 |
| 4,888,961 | A | 12/1989 | McMichael | 62/398 |
| 4,916,910 | A | 4/1990 | Schroeder | 62/59 |
| 4,934,150 | A | 6/1990 | Fessler | 62/59 |
| 5,190,188 | A | 3/1993 | Credle, Jr. | 222/1 |
| 5,234,131 | A | 8/1993 | Griffin | 222/146.6 |
| 5,249,710 | A | 10/1993 | Hassell et al. | 222/146.6 |
| 5,319,947 | A * | 6/1994 | Fischer | 62/389 |
| 5,524,452 | A | 6/1996 | Hassell et al. | 222/146.6 |

FOREIGN PATENT DOCUMENTS

| | | |
|---|---|---|
| FR | 1353415 | 1/1964 |
| JP | 50-32641 | 4/1975 |
| JP | 55-12065 | 1/1980 |
| JP | 63-178780 | 11/1988 |

* cited by examiner

*Primary Examiner*—Aaron J. Lewis

(57) ABSTRACT

A beverage dispenser includes a housing that defines a cooling chamber and has dispensing nozzles mounted thereon, a water line positioned in the bottom of the cooling chamber for communicating water to the dispensing nozzles, product lines mounted in the front of the cooling chamber for communicating product to the dispensing valves, a refrigeration unit mounted over the cooling chamber that includes an evaporator coil extending into the cooling chamber, and an agitator motor mounted over the cooling chamber for driving an impeller located within the cooling chamber. The cooling chamber contains a cooling fluid, a portion of which freezes about the evaporator coil during the operation of the refrigeration unit to form a frozen cooling fluid slab. A frozen cooling fluid bank controller controls the size of the frozen cooling fluid slab, while the mounting of the controller's probe to the side of the evaporator coil facing the front of the housing prevents the frozen cooling fluid slab from freezing to envelop the product lines. The agitator motor drives the impeller to force the unfrozen cooling fluid circuitously about the frozen cooling fluid slab. Additionally, a serpentine configuration of the water line produces channels which direct the flow of unfrozen cooling fluid towards the front and rear walls of the housing, thereby enhancing the circulation of the unfrozen cooling fluid.

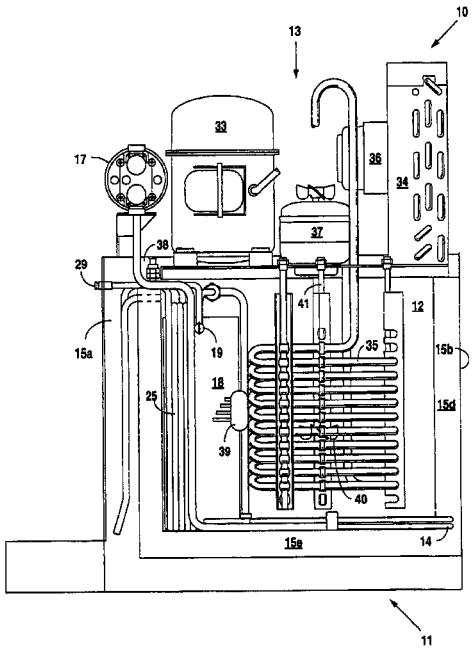

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is cancelled.

Claims 2, 3, and 4 is determined to be patentable as amended.

2. [The apparatus according to claim 1 further ] *A beverage dispenser,* comprising*:*

*a housing defining a cooling chamber having a cooling fluid contained therein;*

*dispensing valves mounted on said housing;*

*a water line for communicating water to said dispensing valves wherein said water line is substantially completely disposed in the bottom of said cooling chamber and has a serpentine configuration defining channels that direct the flow of unfrozen cooling fluid towards a front portion and rear portion of said cooling chamber;*

*product lines positioned in the front of said cooling chamber for communicating product to said dispensing valves;*

*a refrigeration unit mounted over said cooling chamber, said refrigeration unit having an evaporator coil extending into said cooling chamber for freezing cooling fluid thereabout;*

*an agitator for circulating unfrozen cooling fluid along a circuitous path about the interior and exterior of the cooling fluid slab; and* a frozen cooling fluid bank controller having a probe mounted to a side of said evaporator coil facing a front portion of said housing.

3. [The ] *A* beverage dispenser[according to claim 1 further], comprising*:*

*a housing defining a cooling chamber having a cooling fluid contained therein;*

*dispensing valves mounted on said housing;*

*a water line for communicating water to said dispensing valves wherein said water line is substantially completely disposed in the bottom of said cooling chamber and has a serpentine configuration defining channels that direct the flow of unfrozen cooling fluid towards a front portion and rear portion of said cooling chamber;*

*product lines positioned in the front of said cooling chamber for communicating product to said dispensing valves;*

*a refrigeration unit mounted over said cooling chamber, said refrigeration unit having an evaporator coil extending into said cooling chamber for freezing cooling fluid thereabout;*

*an agitator for circulating unfrozen cooling fluid along a circuitous path about the interior and exterior of the cooling fluid slab; and* a carbonator mounted within said cooling chamber and connected to said water line and a $CO_2$ source to supply carbonated water to said dispensing valves.

4. The beverage dispenser according to claim 3 further comprising a manifold mounted within said cooling chamber directly behind [an] *and* abutting said product lines to receive carbonated water from said carbonator and distribute the carbonated water to the dispensing valves.

* * * * *